United States Patent [19]

Bauer et al.

[11] Patent Number: 4,569,636

[45] Date of Patent: Feb. 11, 1986

[54] DEVICE FOR REGULATING THE DELIVERY OF ROTARY COMPRESSORS

[75] Inventors: Friedrich Bauer; Karl Rein, both of Vienna, Austria

[73] Assignee: Hoerbiger Ventilwerke Aktiengesellschaft, Vienna, Austria

[21] Appl. No.: 690,244

[22] Filed: Jan. 10, 1985

[30] Foreign Application Priority Data

Jan. 13, 1984 [AT] Austria ..... 92/84

[51] Int. Cl.[4] ..... F04B 49/02

[52] U.S. Cl. ..... 417/295; 137/527; 137/614.2

[58] Field of Search ..... 417/295; 137/527, 614.2

[56] References Cited

U.S. PATENT DOCUMENTS

| | | | |
|---|---|---|---|
| 1,187,535 | 6/1916 | LaPorte | 137/527 X |
| 1,507,001 | 9/1924 | Robertson | 137/614.2 X |
| 2,991,002 | 7/1961 | Quertier | 417/295 |
| 3,463,189 | 8/1969 | Fitzpatrick | 137/614.2 |
| 4,067,356 | 1/1978 | Kreuz | 137/527 |
| 4,089,623 | 5/1978 | Hofmann | 417/295 |
| 4,406,588 | 9/1983 | Hofmann | 417/295 X |

FOREIGN PATENT DOCUMENTS

| | | | |
|---|---|---|---|
| 151969 | 11/1921 | United Kingdom | 417/295 |

*Primary Examiner*—Richard E. Gluck

*Attorney, Agent, or Firm*—Watson, Cole, Grindle & Watson

[57] ABSTRACT

A device for regulating the delivery of rotary compressors, such as screw-type compressors with oil injection, comprises a regulating valve for varying the cross-sectional area of a suction pipe and a non-return valve which closes said suction pipe. The two valves are disposed one behind the other in the flow direction within a casing incorporating a suction pipe. In order to provide a low resistance to flow and to simplify the construction, both valves are in the form of flap valves with the flap of the non-return valve arranged to close a valve seat provided in the casing and being pivotable against a resetting force about an axis extending outside the cross-sectional area of the valve seat.

5 Claims, 2 Drawing Figures

DEVICE FOR REGULATING THE DELIVERY OF ROTARY COMPRESSORS

BACKGROUND OF THE INVENTION

1. Field of the Invention

The invention relates to a device for regulating the delivery of rotary compressors, more particularly screw-type compressors with oil injection, comprising a regulating valve for varying the cross-sectional area of the suction pipe and a non-return valve tightly closing the suction pipe, the two valves being disposed one behind the other in the flow direction in a casing incorporated in the suction pipe, the regulating valve being constructed as a flap valve having a flap mechanically adjustable by a drive device around an axis of rotation extending diametrically through the flap.

2. Description of the Prior Art

It is known, when operating rotary compressors, to use a suction regulating flap incorporated in the suction pipe to vary the cross-sectional area of the suction pipe in order to adapt the delivery to requirements. The suction pipe must also be tightly closed after the compressor has been switched off, to prevent the compressed medium flowing back through the suction pipe. This is particularly necessary in screw-type compressors, into which oil is injected for lubrication or cooling.

It is known to construct the suction regulating flap so that it also can tightly close the suction pipe. This double purpose, however, is relatively expensive to service, because during operation the suction regulating flap for regulating the delivery is actuated by the drive device, which must be constructed so that it does not interfere with the suction regulating flap after the compressor has been switched off and when the suction pipe is rapidly closed. In addition, suction regulating flaps of the kind in question are difficult to make completely sealing-tight.

To obviate these disadvantages, it is known for a separate non-return valve of known construction to be incorporated in the suction pipe in addition to the suction-regulating flap. The components for closing the non-return valve are loaded by a closing spring, the force of which has to be overcome when opening the valve. The closure components therefore often have a considerable flow resistance, causing additional pressure losses in the suction pipe and consequently reducing the delivery of the compressor, precisely when the full delivery of the compressor is required and no excess capacity is at hand.

U.S. Pat. No. 4,406,588 discloses a suction control device in which the closure member for closing the suction pipe is biased in the closing direction by a spring and in the opening direction by the pressure produced by the compressor. When the compressor starts up, the resulting pressure overcomes the force of the spring and opens the suction pipe. The flow cross-section for regulating the delivery is adjusted by a control piston actuated by a control pressure, e.g. the main pressure, and loading the closure member in the same direction as the force of the spring, so as to overcome the operating pressure on the other side of the closure member. This embodiment eliminates a separate non-return valve, but the known suction control device is of complicated construction, resulting in high prime costs and faults in operation. As before, the spring of the valve which closes the suction pipe causes pressure losses and thus reduces the maximum possible delivery of the compressor.

SUMMARY OF THE INVENTION

The object of the invention is to simplify the known devices for regulating the delivery of rotary compressors and improve them so as substantially to eliminate pressure losses and the resulting reduction in delivery.

To this end, according to the invention, the non-return valve is also constructed as a flap valve having a flap which tightly closes a valve seat in the casing and is disposed so as to pivot against a resetting force around an axis extending outside the cross-sectional area of the valve seat. The device is a simple development of the regulating device consisting only of a hollow casing with the two flaps, but fulfilling all the required functions of a regulating device of the kind in question, including tightly closing the suction pipe. Since the two flaps are disposed one behind the other in the flow direction in the casing, the sucked medium is not deflected, but is conveyed directly through the regulating device to the suction pipe. During full delivery, also, the flaps leave the cross-sectional area of the casing almost completely clear, so that no appreciable flow resistance has to be overcome. This correspondingly reduces the pressure losses and the reduction in delivery caused by the flaps incorporated in the suction pipe.

In a preferred embodiment of the invention, the axes of rotation of the two flaps are disposed so to lie, preferably approximately at right angles to one another. The result, as has been shown in practice, is to quieten the flow in the suction pipe and protect the non-return flap from the medium deflected by the regulating flap when only partly open.

In another optional embodiment, the force for resetting the non-return valve is a spring, one end of which acts on a lever arm connected to the flap whereas the other end is anchored in the casing, the anchoring place in the casing being chosen so that when the flap is closed, the direction of force of the spring is approximately at right angles to the plane extending through the axis of rotation and the point of engagement of the spring on the lever arm, whereas when the flap is open the included angle is acute and much smaller.

This embodiment and spatial arrangement of the resetting spring ensures that when there is no suction flow, the non-return valve flap is firmly closed with adequate force and is held tight-sealed. When there is a flow, on the other hand, the closing force applied by the spring to the non-return valve flap is relatively small, so that the flap releases the entire cross-sectional area in response to a small flow and does not cause any appreciable flow resistance.

Substantially the same advantages are achieved by another variant of the invention in which the flap of the non-return valve has a resetting force in the form of a weight which is secured to a lever arm extending diametrically from the flap along the axis of rotation, so that when the non-return valve is closed the weight is approximately at the same height horizontally near the axis of rotation, whereas when the valve is open the weight engages the lever arm near a vertical plane through the axis of rotation. Without a spring, this system ensures that when the flap valve is closed the closing force is sufficiently great to ensure sealing-tightness, whereas when the valve is open the closing force is small, resulting in a low flow resistance and correspondingly low pressure losses.

In a final optional advantageous embodiment of the device according to the invention, the regulating-valve flap is disposed in the flow direction of the sucked medium, in front of the non-return valve flap and in a common casing. When the compressor is switched off, the suction pipe is closed very near the compressor and prevents the medium mixed with oil from flowing back into the regulating-flap region.

BRIEF DESCRIPTION OF THE DRAWINGS

The invention will be further described, by way of example, with reference to the accompanying drawings, in which.

Figure 1:
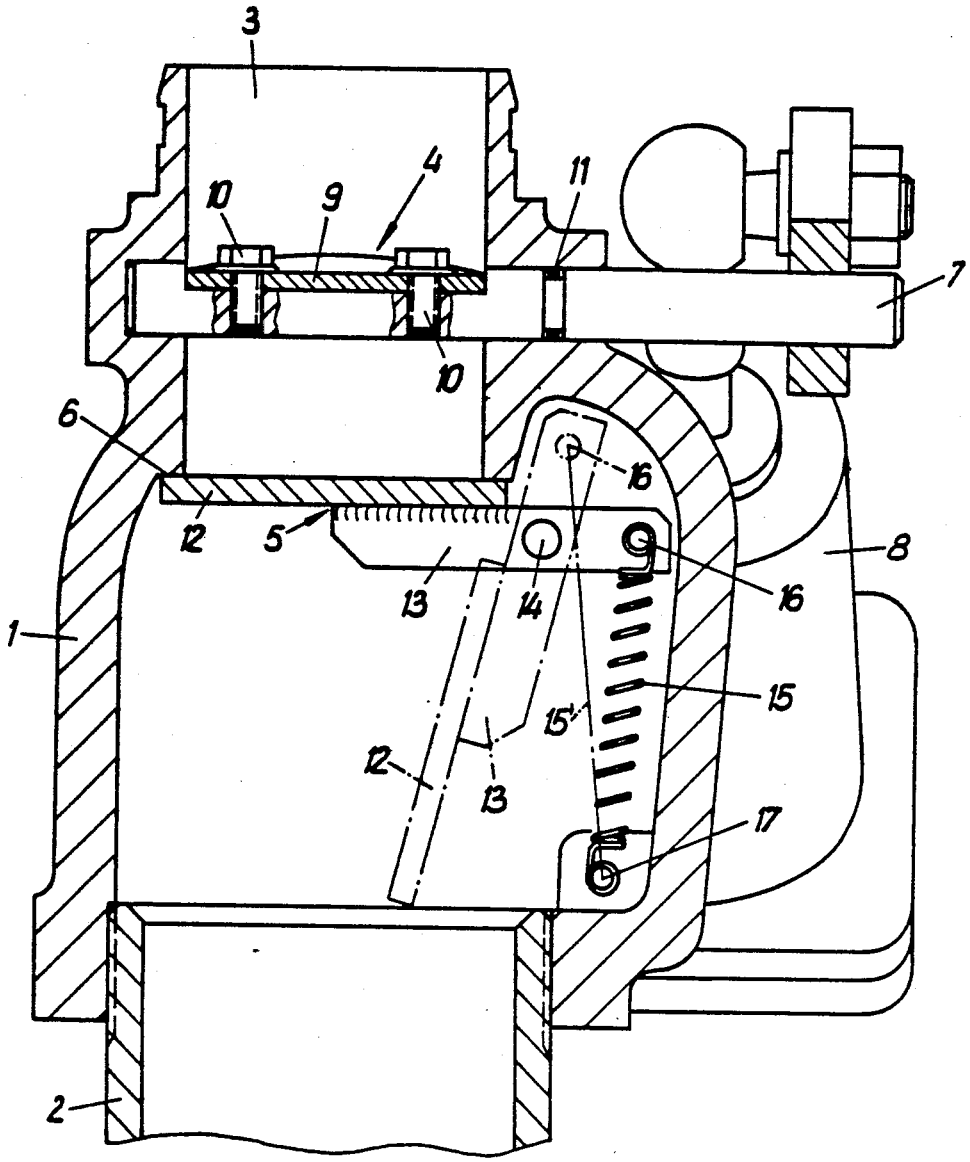
FIG. 1 shows an axial section through the middle of a first embodiment of the regulating device according to the invention.

In both embodiments, the device for regulating the delivery of rotary compressors comprises a casing 1 placed on a suction pipe 2 of the compressor (not shown) and having a flow pipe 3 adjacent the suction pipe 2. Casing 1 contains a regulating valve 4 and a non-return valve 5 co-operating with a valve seat 6. Valve 4 is actuated via a rotary axle 7, in the form of a shaft, connected to a drive device 8, e.g. a hydraulic or pneumatic actuating cylinder, shown in FIG. 1.

Valves 4 and 5 are both constructed as flap valves. Valve 4 comprises a flap 9 secured to the shaft 7 by screws 10. Shaft 7 is sealed by an O-ring 11. Valve 5 has a flap 12 which tightly closes valve seat 6 and is mounted on a lever arm 13 for pivotal movement about a shaft 14. The axis of the axle 7 extends substantially diametrically through flap 9, whereas the shaft 14 is mounted in the housing 1 outside the cross-sectional area of the valve seat 6, so that the flap 12 can be completely pivoted away from the seat 6. The result is to leave practically the entire cross-section of pipe 3 free for the sucked medium, which is conveyed straight through pipe 3 without deflection. This results in a low flow resistance in the regulating device, which causes practically no appreciable pressure losses and does not disadvantageously reduce the delivery.

In the embodiment in FIG. 1, the non-return valve is loaded in the closing direction by a spring 15 engaging lever arm 13 at a point 16 embodied by a spigot, the lever arm extending away from flap 12 on the other side of axis 14. The output end of spring 15 is anchored in casing 1. The anchoring location 17 is chosen so that when flap 12 is closed the direction of force of spring 15 is approximately at right angles to an imaginary plane extending through the shaft 14 and the place of engagement 16 of spring 15 on lever arm 13, as shown in FIG. 1. Spring 15 acts via a long lever arm on flap 12 and exerts almost its maximum closing force, so that valve 5 is firmly held closed. When flap 12 is fully open, on the other hand, the direction of force of spring 15, indicated by 15' in FIG. 1, includes a relatively small acute angle with the imaginary plane extending through the shaft 14 and place 16. As a result the closing force is greatly reduced, so that valve flap 12 can be rapidly open wide.

Figure 2:
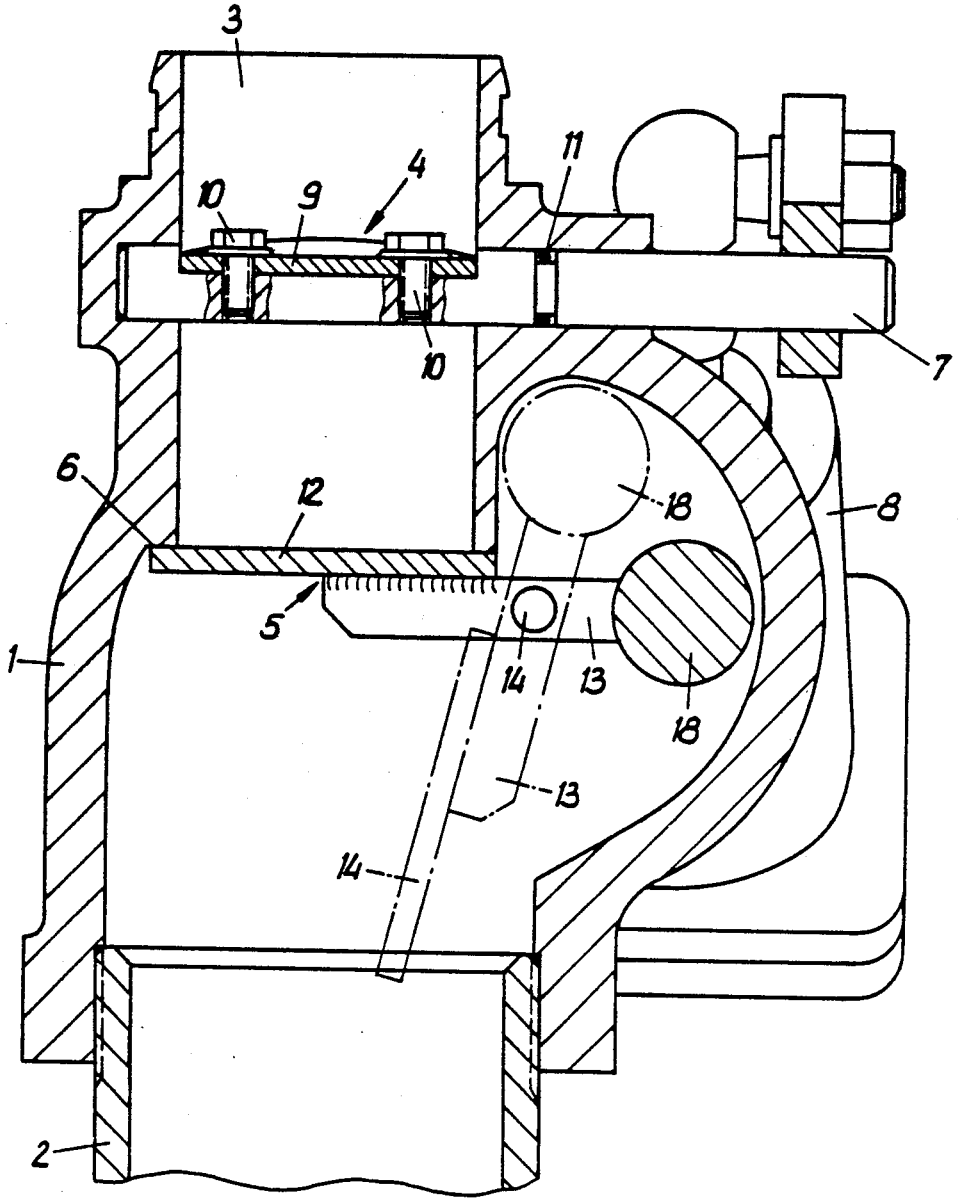
FIG. 2 shows an axial section through the middle of another embodiment.

In the embodiment shown in FIG. 2, flap 12 is loaded by a weight 18 providing the resetting force. Weight 18 is disposed at the end of one or more lever arms 13 on the side of axis 14 diametrically opposite flap 12. When valve 5 is closed, weight 18 is approximately level with the shaft 14, thus exerting the maximum closing force on flap 12. When flap 12 is fully open, as shown chain-dotted in FIG. 2, weight 18 is above the shaft 14 and substantially in a vertical plane through the axis of the shaft 14. The torque exerted on the shaft 14 and the resulting closing force on flap 12 are correspondingly small. This embodiment therefore likewise ensures that flap 12 opens quickly and that the cross-sectional area is straight and at its maximum size, so that the flow resistance is small.

As can be seen in both embodiments, the axis of rotation of the shaft 7 and of valve 4 and the axis of rotation of the shaft 14 and of valve 5 are at approximately right angles to one another. This prevents the flow of sucked medium, which is deflected somewhat to the side by flap 9 in the flow pipe 3, from striking flap 12 in the direction for pivoting it. Also, valve 5 is disposed nearer pipe 2 than valve 4. When therefore the compressor is switched off, the medium under pressure, which is mixed with oil or another injected fluid, is kept away from valve 4.

We claim:

1. A device for regulating the delivery of a rotary compressor having a suction pipe, comprising, a casing incorporating a flow pipe, said casing being mounted on said suction pipe such that said pipes and said casing are coaxial and said pipes are spaced apart in an axial direction of flow therethrough, said casing having an annular valve seat at a downstream end of said flow pipe, said valve seat lying radially outwardly of an inner wall of said flow pipe, a regulating flap valve on said casing for varying the cross-sectional area of said flow pipe, said valve having a flap with an axis of rotation extending diametrically thereto, drive means for adjusting said flap about said axis of rotation, a non-return valve mounted on said casing for pivotal movement about an axis spaced outwardly of said valve seat, said non-return valve comprising a flap valve including a flap engageable with said valve seat in a closing position of said non-return valve, said regulating valve and said non-return valve being disposed one behind the other in said direction of flow, and means for applying a resetting force to said flap of said non-return valve about said axis thereof.

2. A device as set forth in claim 1, wherein said axes lie at substantially right angles to one another.

3. A device as set forth in claim 1, wherein said non-return valve includes a lever arm connected to said flap thereof, said arm extending outwardly of said axis of said non-return valve, said means comprising a spring connected at one end to an outer end of said arm, said spring being anchored at an opposite end to said casing, said opposite ends being aligned substantially perpendicular to a plane containing said axis of said non-return valve and said one end of said spring, whereby when said flap of said non-return valve is closed said spring exerts a force substantially perpendicular to said plane, and when said flap of said non-return valve is open said spring exerts said force in a direction which includes an acute angle with said plane.

4. A device as set forth in claim 1, wherein said non-return valve includes a lever arm connected to said flap thereof, said arm extending outwardly of said axis of said non-return valve, said means comprising a weight secured to an outer end of said arm such that when said non-return valve is closed said weight lies in a horizontal plane containing said axis of said non-return valve, and when said non-return valve is open said weight lies in a substantially vertical plane containing said axis of said non-return valve.

5. A device as set forth in claim 1, wherein said regulating valve is disposed up-stream of said non-return valve with respect to said flow direction in said casing.

* * * * *